US005147510A

United States Patent [19]

Iura et al.

[11] Patent Number: 5,147,510

[45] Date of Patent: Sep. 15, 1992

[54] FLAT MULTICORE WIRE AND METHOD OF FORMING THE SAME WIRE

[75] Inventors: Kazuo Iura, Kameyama; Yoshiaki Yamano, Suzuka; Kazuhito Saka, Mie, all of Japan

[73] Assignee: Sumitomo Wiring Systems, Ltd., Japan

[21] Appl. No.: 653,069

[22] Filed: Feb. 8, 1991

[30] Foreign Application Priority Data

Feb. 9, 1990 [JP] Japan ..... 2-31166

[51] Int. Cl.[5] ..... H01B 7/08

[52] U.S. Cl. ..... 174/117 F; 174/117 FF; 174/117 AS; 174/117 A

[58] Field of Search ..... 174/117 R, 117 F, 117 FF, 174/117 AS, 117 A, 74 R

[56] References Cited

U.S. PATENT DOCUMENTS 3,733,428 5/1973 Fry ..... 174/117 F X
4,154,977 5/1979 Verma ..... 174/117 F
4,357,750 11/1982 Ostman ..... 174/117 F X

FOREIGN PATENT DOCUMENTS 14891 2/1977 Japan ..... 174/117 F
39190 3/1977 Japan ..... 174/117 F
194413 12/1988 Japan .
196517 12/1988 Japan .

*Primary Examiner*—Morris H. Nimmo
*Attorney, Agent, or Firm*—Jordan B. Bierman

[57] ABSTRACT

A flat multicore wire of the present invention has an end structure in which a group of round wires are disposed in a plane-like fashion in parallel with each other at predetermined intervals. In which coatings of the end portions of the group of round wires are uniformly peeled off so as to enable a group of exposed conductors so formed to act as contact portions, in which a connecting tape of a certain length is applied over the top surface of the coatings of the group of round wires along the proximal portions of the contact portions, and in which a securing tape is applied on the underside of the group of exposed conductors in such manner that the securing tape extends over a part of the coatings of the group of round wires.

9 Claims, 10 Drawing Sheets

FLAT MULTICORE WIRE AND METHOD OF FORMING THE SAME WIRE

BACKGROUND OF THE INVENTION

1. Field of the Invention

The present invention relates to a flat multicore wire for use for wiring between flexible printed circuit boards and a method of forming the same wire, and more particularly to a structure for the end portion of such a flat multicore wire and a method of forming the end portion of the same wire.

2. Statement of the Prior Art

There are known a number of types of flat multicore wires, some of which are disclosed in the official gazettes of Japanese Utility Model Laid-Open Nos. 196517/1988, 194413/1988 and so forth. For instance, FIG. 8 shows a flat multicore wire having a conventional structure, and FIG. 8(A) is a plan view of the flat multicore wire, FIG. 8(B) being a front view of the same wire. FIG. 9 also shows another flat multicore wire having a conventional structure, and FIG. 9(A) is a plan view of the flat multicore wire, FIG. 9(B) being a front view of the same wire. FIG. 10 shows still another flat multicore wire having a conventional structure, and FIG. 10(A) is a plan view of the flat multicore wire, FIG. 10(B) being a front view of the same wire.

As shown in FIG. 8, round wires 1 are disposed in parallel in a plate-like fashion with predetermined gaps provided therebetween, and coatings of the end portions of the respective wires are peeled off so as to expose conductors of a certain length. Connecting tapes 5 are applied over the top and bottom surfaces of the coating portions of a group of round wires 1 along the proximal portions of these exposed conductors 2 (hereinafter, simply referred to as a conductor 2) so as to secure the parallel position of the group of wires. Thus, the end portion of the group of wires is constructed such that the conductors 2 act as contact portions for an element that is connected thereto. Moreover, as shown in FIG. 9, in order to prevent bending of the known conductors 2 as shown in FIG. 8, a sheath body 11 for holding a group of conductors 2 together is provided transversely of the conductors 2 at intermediate positions along the length thereof.

In addition, referring to FIG. 10, elongate rectangular conductors 12 for a thin plate or foil body such as an FPC (flexible printed circuit board) or an FFC (flat flexible circuit board) are disposed with predetermined intervals, and are then secured by holding tapes 13 that are applied over the top and bottom surfaces of the same conductors 12 along the full length thereof. Only the top surfaces of the rectangular conductors 12 are exposed at the distal ends thereof over some length so that the exposed portions function as a contact portion 3.

Among the above-described conventional flat multicore wires, in the flat multicore wire shown in FIG. 8, since the rigidity of the conductors 2 projecting in a cantilever-like fashion is in sufficient, the conductors 2 are easy to "bend or buckle" due to resistance generated when a connector is fitted thereover. In order to compensate for the lack of rigidity even to a small extent, wires to be used are limited to tinted wires or solid wires, and thus, since stranded wires are not suitable for use with a flat multicore wire of this type, the flexibility of the entire wires including the contact portion 3 is not good. Thus, the flat multicore wire shown in FIG. 8 has the drawback that it is not suitable for use a moving portion where a connection include a bend, or where wires are repeatedly bent at an intermediate position along the length thereof.

Furthermore, in the flat multicore wire as shown in FIG. 9 in which the rigidity of the conductors 2 is intended to be improved, although the above-mentioned bending or buckling of the conductors is prevented, since the conductors 2 are inserted into a connector together with the sheath body 11, a great magnitude of insertion force is required, resulting in a low operating efficiency. In particular, since the resin sheath body 11 becomes hard in winter when the temperature becomes low, the efficiency with which the conductors 2 are inserted into a connector remarkably decreases.

In contrast, in the flat multicore wire as shown in FIG. 10, since the conductors themselves are each formed into a rectangular shape, the flexural rigidity relative to the transverse direction is high, and therefore there is no "bending or buckling" of the conductors that would be caused when the conductors are inserted into a connector. However, since the holding tapes 13 are applied to the top and bottom surfaces of a group of rectangular conductors 12 along the full length thereof, the flexural rigidity of the entire wires relative to the transverse direction becomes high, and therefore the flat multicore wire in FIG. 10 suffers from the drawback that it is not suitable for a two-dimensional application. Moreover, it has another drawback that the rectangular conductors 12 cannot be arranged together using sealed wires.

SUMMARY OF THE INVENTION

An object of the invention is to provide a flat multicore wire capable of solving the above-mentioned drawbacks and a method of forming the same wire.

In order to attain the above object, the present invention provides a flat multicore wire characterized by an end structure in which a group of round wires are disposed in a plane-like fashion in parallel with each other with predetermined intervals, in which coatings of the end portions of the group of round wires are uniformly peeled off so as to enable a group of exposed conductors to act as contact portions, in which a connecting tape of some length is applied over the top surface of the coatings of the group of round wires along the proximal portions of the contact portions, and in which a securing tape is applied on the underside of the group of exposed conductors in such a manner that the securing tape extends over a part of the coatings of the group of round wires.

The leading end portions of the group of exposed conductors may be held and secured by means of the securing tape that is bent over upon the group of exposed conductors from the underside therefrom, or by means of an adhesive. Alternately, the leading end portions of the group of exposed conductors may be pressed vertically so as to be formed into flat end portions. Thus, means for preventing the disintegration of the conductors may be provided.

The group of exposed conductors may be pressed vertically so as to be formed into flat conductors.

Round wires may be arranged together with sealed wires, and a group of exposed conductors of the round wires and sealed wires may be formed into contact portions with securing and connecting tapes being applied to a group of round and sealed wires.

The present invention also provides a method of forming a flat multicore wire comprising the steps of disposing a group of round wires in a plane-like fashion in parallel with each other with predetermined intervals, applying a connecting tape over the top surface of the group of round wires with some part of the end portions of the group of round wires being left uncovered, afterwards peeling off coatings of the part of the group of round wires projecting from the connecting tape so as to form a group of exposed conductors, and applying a securing tape on the underside of the group of exposed conductors in such a manner that the securing tape extends over a part of the coatings of the group of round wires.

DETAILED DESCRIPTION OF THE PREFERRED EMBODIMENTS

Figure 1A:
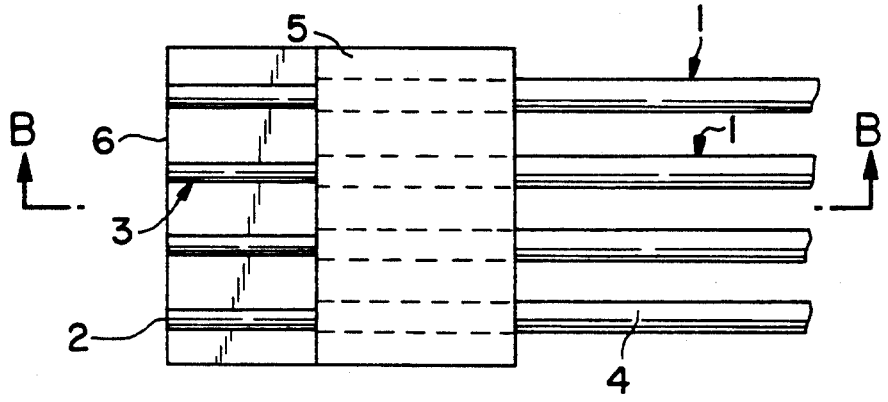
FIG. 1 shows a basic structure of a flat multicore wire according to the present invention, FIG. 1(A) being a plan view of the same flat multicore wire, FIG. 1(B) being a longitudinal sectional view taken along the line B—B of FIG. 1(A), FIG. 1(C) being a cross-sectional view taken along the line C—C of FIG. 1(A), and FIG. 1(D) being a cross-sectional view taken along the line D—D of FIG. 1(A)
Figure 1B:
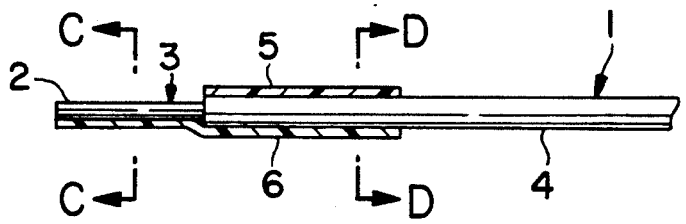
Figure 1C:
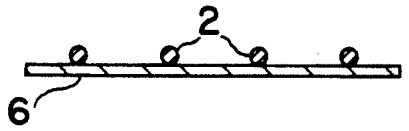
Figure 1D:
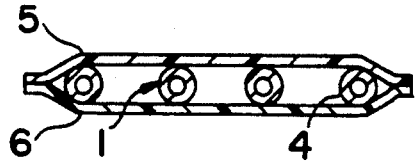

Referring to FIG. 1 showing a basic structure for a flat multicore wire of the present invention, a flat multicore wire of the present invention comprises a group of round wires 1 disposed in a plane-like fashion in parallel with each other with predetermined intervals. Exposed conductors 2 produced by uniformly peeling off coatings 4 at the end portions of the group of round wires over a certain length thereof are formed into contact portions 3. A connecting tape 5 of a certain length is applied over the top surface of the coatings 4 of the group of round wires 1. A securing tape 6 is also applied to the underside of the exposed conductors 2 in such a manner that the securing tape extends over some part of the coatings 4 of the group of round wires 1.

Figure 2A:
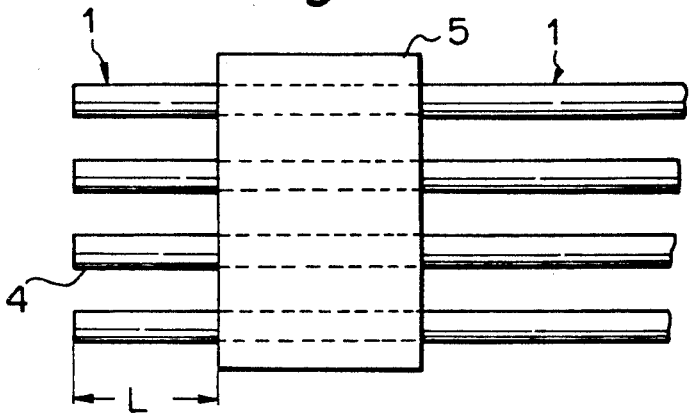
FIG. 2 shows a procedure of forming the flat multicore wire according to the present invention, FIGS. 2(A), (B), (C) being plan views showing a procedure of processing, respectively, and FIGS. 2(D), (E), (F) being front views showing a procedure of processing, respectively.
Figure 2B:
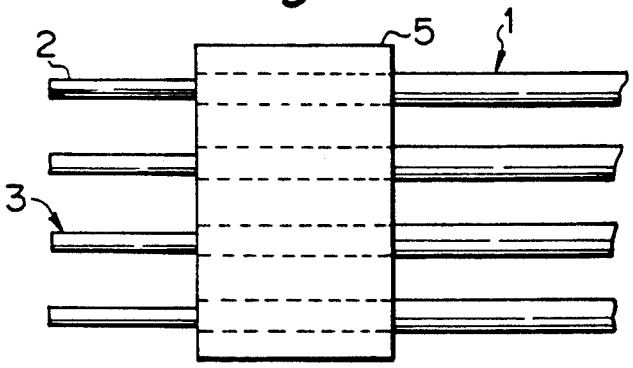
Figure 2C:
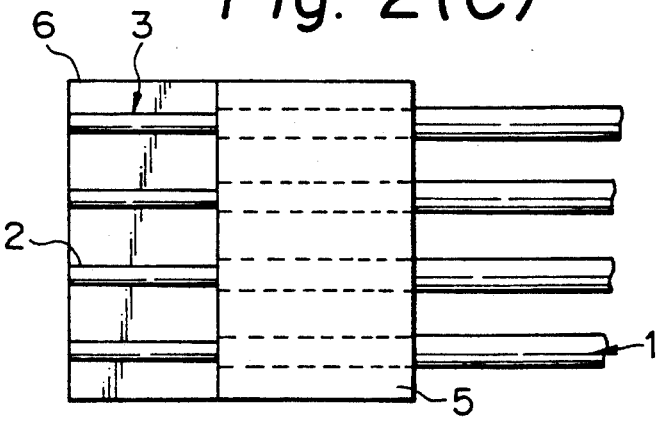
Figure 2D:
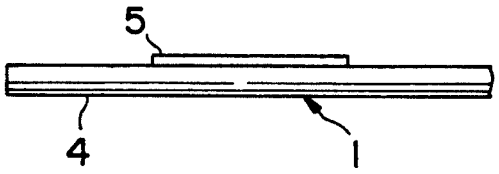
Figure 2E:
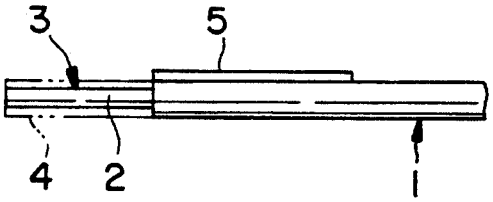
Figure 2F:
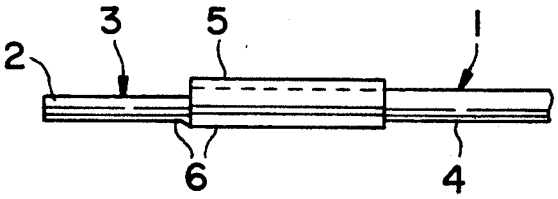

A procedure of forming the flat multicore wire according to the present invention is illustrated in FIGS. 2(A), 2(D); 2(B), 2(E); 2(C), 2(E). A group of round wires 1 are disposed in a plate-like fashion in parallel with each other with predetermined intervals. A connecting tape 5 of a certain length is applied over the top surface of the group of round wires 1 with some part L of the leading ends of the group of round wires being left uncovered [(A), (D)]. Afterwards, coatings 4 of the group of round wires 1 projecting from the connecting tape 5 are peeled off so as to form exposed conductors 2 [(B), (E)]. Following this, a securing tape 6 is applied on the underside of the exposed conductors 2 in such a manner that the securing tape 6 extends over some part of the coatings 4 of the group of round wires 1 so that the top surface of the exposed conductors 2 may be formed into contact portions 3 [(C), (F)].

Figure 3A:
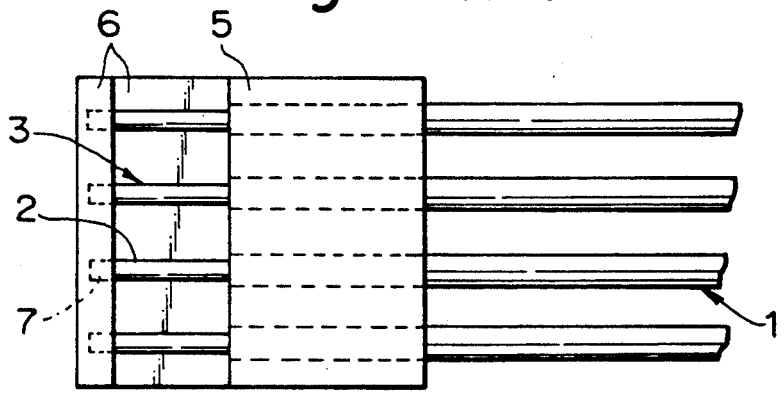
FIG. 3 shows an embodiment of the flat multicore wire of the present invention, FIGS. 3(A), (B), (C) being plan views of the embodiment, respectively, and FIGS. 3(D), (E), (F) being front sectional views of the same embodiment, respectively.
Figure 3B:
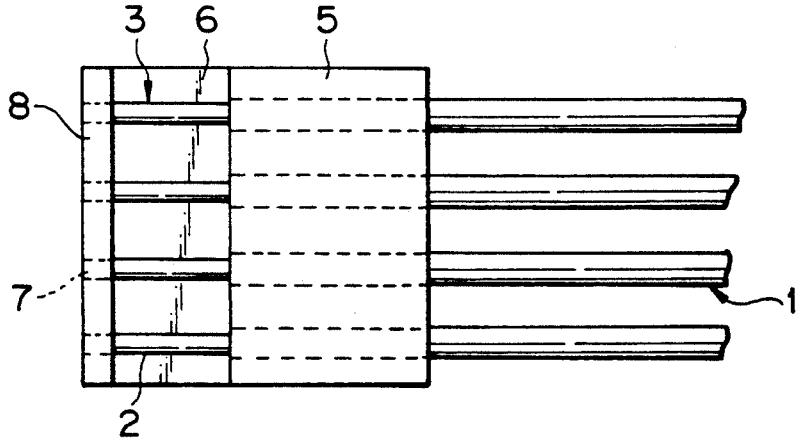
Figure 3C:
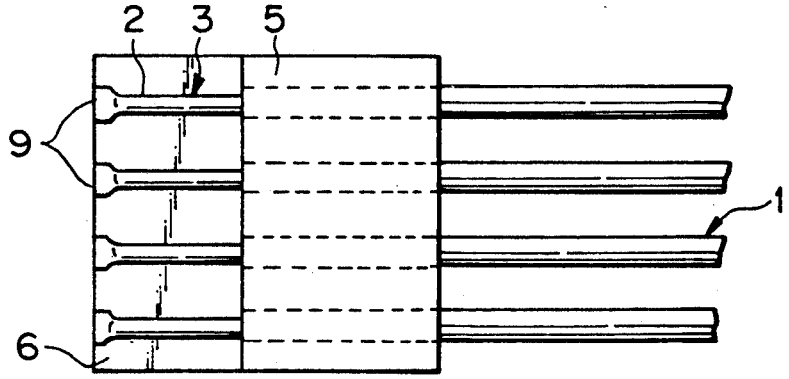
Figure 3D:
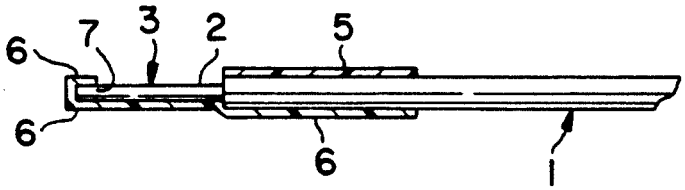
Figure 3E:
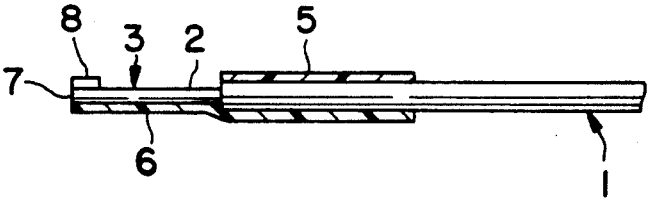
Figure 3F:
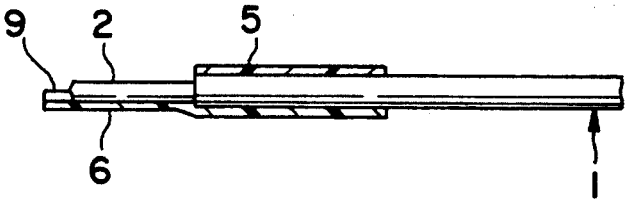
Figure 4A:
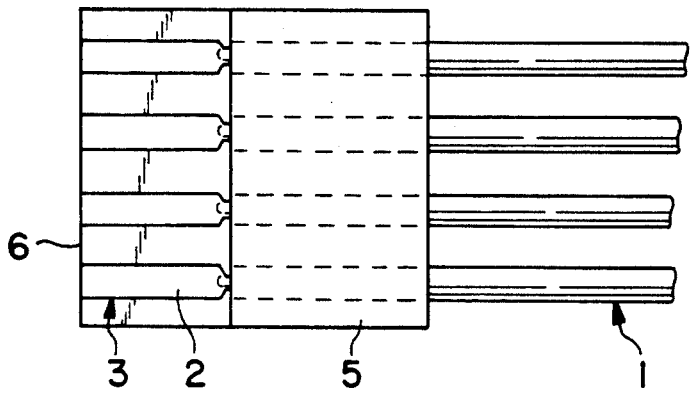
FIG. 4 shows another embodiment of the flat multicore wire according to the present invention, FIG. 4(A) being a plan view of the embodiment, and FIG. 4(B) being a front sectional view of the same embodiment.
Figure 4B:
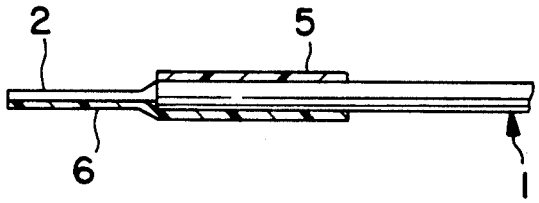
Figure 5:
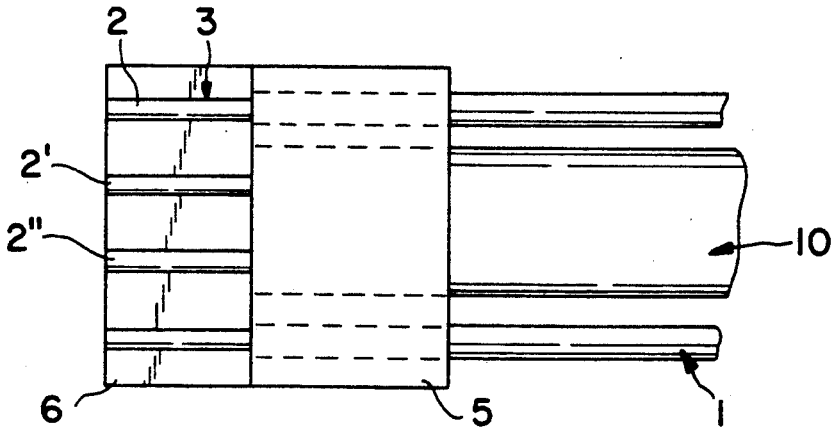
FIG. 5 shows a further embodiment of the flat multicore wire according to the present invention.

Referring to FIGS. 3 to 5, another embodiment of the flat multicore wire according to the present invention will be described in which in addition to the basic structure of the above first invention, an additional requirement is fulfilled.

First, referring to FIG. 3 illustrating a basic structure of the embodiment, a flat multicore wire illustrated in FIG. 3 has a means for preventing the disintegration of the exposed conductors 2 provided in the end structure in which, as in the case of the first invention, a group of round wires 1 are disposed in parallel, in which exposed conductors 2 are formed into contact portions 3, and in which a connecting tape 5 and securing tape 6 are applied to the above constituent elements.

To be specific, as shown in FIG. 3(A), the securing tape 6 applied to the underside of the flat multicore wire is bent over upon the leading end portions 7 of the exposed conductors 2 so as to hold and secure the same leading end portions 7, the leading end portions 7 being thus wrapped up. Alternately, as shown in FIGS. 3(B) and 3(E), the leading end portions 7 are hardened by means of an adhesive 8, or as shown in FIGS. 3(C) and 3(F), only the leading ends of the exposed conductors 2 are pressed vertically so that the leading ends are formed into flat leading end portions 9, which are then secured to the securing tape 6.

Next, another basic structure is shown in FIG. 4. As in the case of the flat multicore wire shown in FIG. 3, a flat multicore wire shown in FIG. 4 has the same basic structure as that of the first invention. In addition, the flat multicore wire has an additional means for reducing the insertion force of a connector, as well as improving the function of the connecting portion. Round conductors of round wires 1 are pressed vertically along substantially the full length of the exposed conductors 2 so as to be formed into a flat plate-like shape.

Finally, a flat multicore wire shown in FIG. 5 comprises contact portions 3, a connecting tape 5, and a securing tape 6 which are similar to those constituting the first invention. In addition to this, the flat multicore wire of FIG. 5 has a sealed wire 10 disposed between a group of round wires 1. The sealed wire 10 is disposed between the round wires 1. The sealed wire 10 is disposed between the round wires 1 in parallel therewith with predetermined intervals. The contact portions 3 are constituted by the exposed conductors 2 of the round wires 1 and two exposed conductors 2' and 2" of the sealed wire 10 (an exposed conductor 2' of an electrically communicating wire and an exposed conductor 2" of a drain wire of the sealed wire). Connecting and securing tapes 5, 6 similar to those used in the first invention are applied to these contact portions 3, whereby the flat multicore wire is formed in which the sealed wire is disposed together with the round wires.

In the above-described structures according to the present invention, the length of the exposed conductors 2 constituting the contact portions 3 are determined such that it corresponds to the contact portions of an element to be connected thereto such as a connector. Normal resin tapes including an adhesive layer made from such a material as PVC or PET may be used for the connecting and securing tapes 5, 6.

Figure 6A:
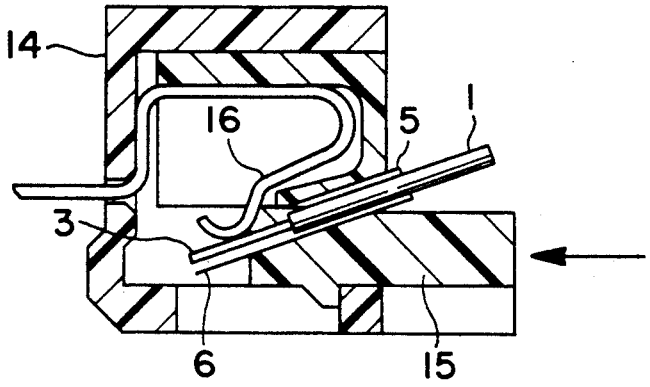
FIG. 6 is shows a state in which the flat multicore wire of the present invention is in use, FIG. 6(A) showing a state in which a presser body has not yet been press inserted, and FIG. 6(B) showing a state in which the presser body has been inserted.
Figure 6B:
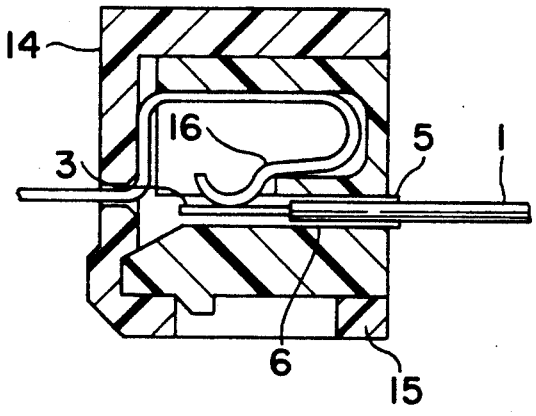

In the flat multicore wire having any of the end structures according to the present invention, as shown in FIG. 6, the contact portions 3 are inserted into a connector 14 with the connecting and securing tapes 5, 6 being applied thereto [FIG. 6(A)]. When in use, an electrical communication is established when a presser body 15 of the connector 14 is press inserted thereinto so that the contact portions 13 are brought into contact with terminals 16 in the connector 14 [FIG. 6(B)].

With the flat multicore wire according to the above first and second inventions, since the contact portions 3 defined by the exposed conductors 2 is secured and held by means of the securing tape 6 extending over the part of the coatings 4 of the round wires 1, good mechanical stability of the contact portions 3 is provided. Therefore, even when a resisting force acts thereon when the contact portions 3 are inserted into a connector, "disintegration of the parallel positioning, bending and buckling" of the exposed conductors 2 is prevented, thereby making it possible to easily and accurately insert the contact portions into a connector.

Moreover, since stranded conductors can be employed due to the improved mechanical stability of the contact portions 3, the flexibility of the entire wire including the contact portions 3 is improved, whereby the adaptability of the flat multicore wire is improved, thereby making it possible to be used for a connection needing a two-dimensional bending or moving wiring in which wiring is repeatedly bent as an intermediate position along the length thereof.

Furthermore, with the flat multicore wire having the means for preventing "disintegration" of the exposed conductors 2 as shown in FIG. 3, since highly-stranded structured conductors having more flexibility than the aforementioned stranded conductors can be used, further remarkable flexibility can be provided. In addition, with the flat multicore wire having the structure shown in FIG. 4, the insertion efficiency of the contact portions into a connector is further improved, and the efficiency with which electrical connection is established between the contact portions and a connector is also advantageously improved.

In addition, with the flat multicore wire as shown in FIG. 5, since the wire is constituted by the round wires and the sealed wire disposed therewith, the functions of the flat multicore wire are improved.

Figure 7A:
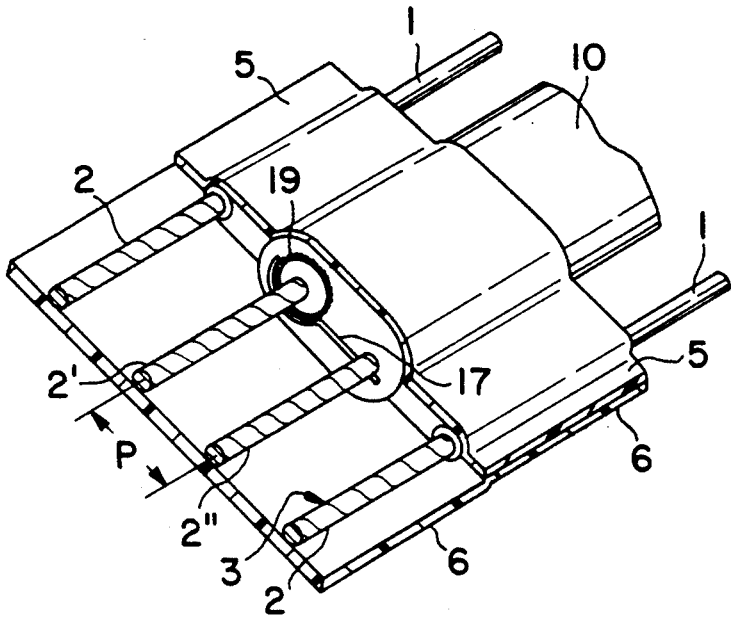
FIG. 7 shows an example of the flat multicore wire according to the present invention, FIG. 7(A) being a perspective view of the example flat multicore wire, and FIG. 7(B) being a cross-sectional view of a sealed wire for use with the same wire.
Figure 7B:
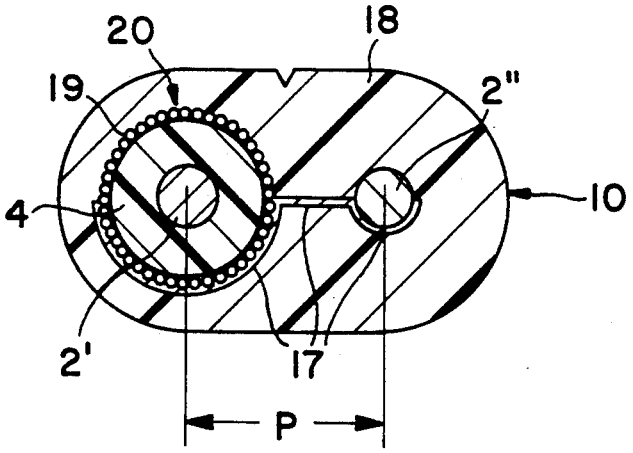
Figure 8A:
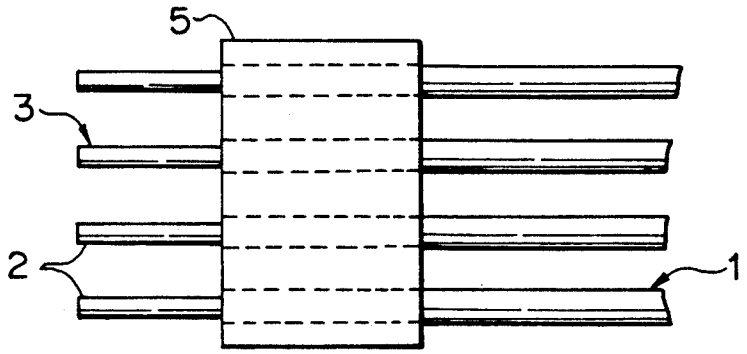
Fig. 8(A) PRIOR ART
FIG. 8 shows a flat multicore wire having a conventional structure, FIG. 8(A) being a plan view of the conventional flat multicore wire, and FIG. 8(B) being a front view of the same wire.
Figure 8B:
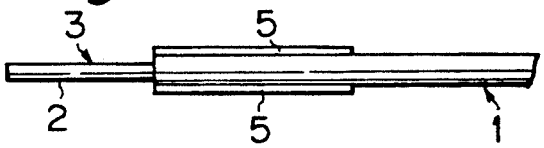
Fig. 8(B) PRIOR ART
Figure 9A:
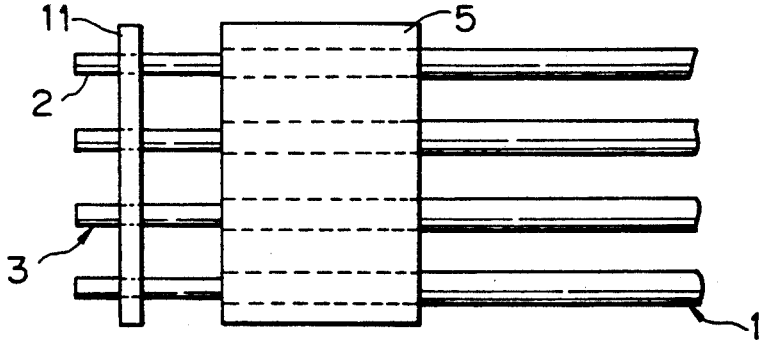
Fig. 9(A) PRIOR ART
FIG. 9 shows a flat multicore wire having another conventional structure, FIG. 9(A) being a plan view of the conventional multicore wire, and FIG. 9(B) being a front view of the same wire.
Figure 9B:
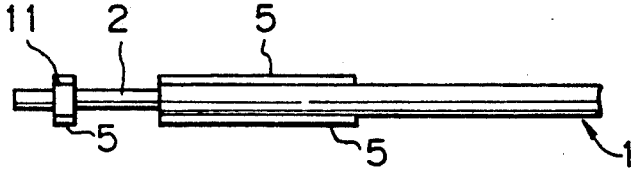
Fig. 9(B) PRIOR ART
Figure 10A:
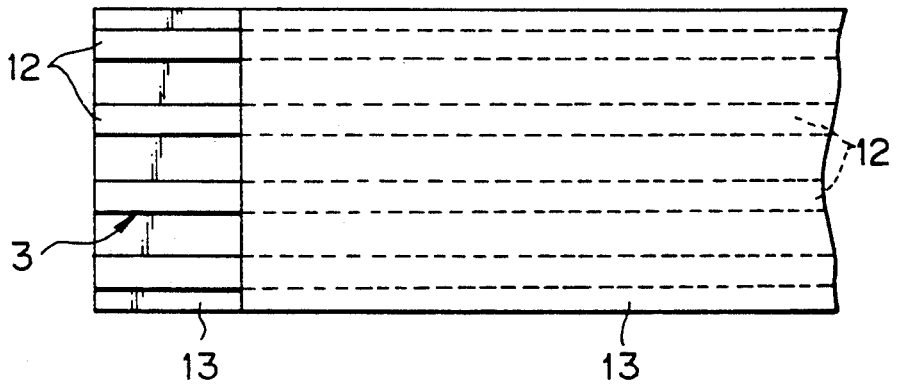
Fig. 10(A) PRIOR ART
FIG. 10 shows a flat multicore wire having a further conventional structure, FIG. 10(A) being a plan view of the conventional multicore wire, and FIG. 10(B) being a front view of the same wire.
Figure 10B:
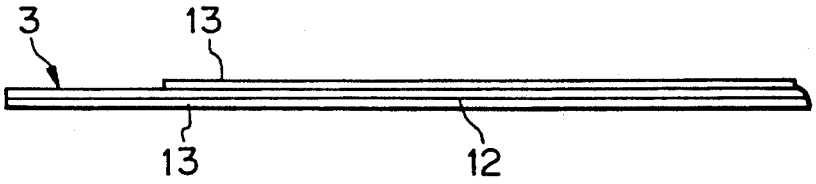
Fig. 10(B) PRIOR ART

Next, referring to FIG. 7, an embodiment of the flat multicore wire shown in FIG. 5 in which the sealed wire is used together will be described, as shown in FIG. 7(B), in the sealed wire 10 of this embodiment, an insulating coating 4 formed from a resin having insulation properties such as polyethylene by employing an extrusion process is provided on the outer circumference of a tin-coated stranded conductor 2', and an insulated conductor 20 embedded in an insulating material and a conductor 2" of a tin-coated stranded drain wire are disposed in parallel with each other at a predetermined interval P as measured from the conductor 2' as a center, and this pitch P is made the same as the pitch of the accommodating portion of a connector to which the sealed wire is connected.

A sealing layer 19 is formed on the outer circumference of the insulated conductor 20 by longitudinally providing copper wires or the like as a sealing material around the same insulated conductor 20, and metal tape 17 such as an "aluminum foil-polyester laminated tape" is transversely provided such that the metal tape 17 is brought into contact with the outer circumference of the sealing layer 19 at one end thereof, while it is wound around the conductor 2" of the drain wire at the other end, whereby an electrical communication between the sealing layer 19 and the drain wire conductor 2" is established. Finally, an insulating jacket 18 is formed such that the jacket separates the respective constituted elements therein so as to form the sealed wire 10.

The round wires 1 are disposed on the sides of this sealed wire 10 with predetermined intervals provided therebetween, and as in the case of the above first invention, the contact portions 3 are formed by applying the connecting and securing tapes 5 and 6 to the exposed conductors 2 of the round wires 1, as well as to the exposed conductors 2', 2" of the sealed wire 10.

In accordance with the embodiment shown in FIG. 7, the sealed wire 10 itself is flexible due to the use of stranded wires 10 therein, and since the pitch P between the conductors 2' and 2" of the sealed wire 10 corresponds to the pitch of the accommodating portion of the connector, connection between the conductors and the connector becomes extremely good. The above-mentioned sealing layer 19 may be formed by providing a braid of a sealing material around the insulated conductor instead of longitudinally providing the sealing materials therearound.

As is described above, with the flat multicore wire according to the present invention, the efficiency with which the wire is inserted into a connector for electrical connection can be improved, and the flexibility and flexing resistance of the entire wire can be improved. In addition, the functions as a wire can be improved due to the use of a sealed wire together with rounded wires. Thus, the present invention is advantageous in that it can provide a high-quality and high-performance flat multicore wire that satisfies the technical requirements for the industrial field concerned.

What is claimed is:

1. A flat multicore cable characterized by an end structure in which a plurality of round wires is disposed in a planar configuration parallel to each other and spaced apart at predetermined intervals, insulating coatings on said wires, said coatings uniformly peeled off end portions of said wires to form a group of exposed conductors which act as contact portions, a connecting tape of some length applied to a top surface of said coatings along proximal portions of said contact portions, and a securing tape on an underside of said exposed conductors whereby said securing tape extends over a part of said coatings of said round wires.

2. The flat multicore cable of claim 1 wherein said exposed conductors are secured by said securing tape being over leading edge portions.

3. The flat multicore of claim 1 further comprising a sealed wire, said group of exposed conductors and said sealed wire constituting contact portions, and said securing tape and said connecting tape being applied to said group of said round wires and said sealed wire.

4. The flat multicore cable of claim 1 wherein said exposed conductors are secured by an adhesive.

5. The flat multicore cable of claim 1 wherein leading ends of said exposed conductors are flattened.

6. The flat multi core cable of claim 1 further comprising a sealed wire, said group of exposed conductors and said sealed wire constituting contact portions, and said securing tape and said connecting tape being applied to said round wires and said sealed wire.

7. The flat multi core cable of claim 4 further comprising a sealed wire, said group of exposed conductors and said sealed wire constituting contact portions, and said securing tape and said connecting tape being applied to said round wires and said sealed wire.

8. The flat multi core cable of claim 5 further comprising a sealed wire, said group of exposed conductors and said sealed wire constituting contact portions, and said securing tape and said connecting tape being applied to said round wires and said sealed wire.

9. A method of forming a flat multicore cable comprising disposing a plurality of round wires in a planar configuration parallel to each other and spaced apart at predetermined intervals, said wires having a coating thereon, said method comprising applying a connecting tape over a top surface of said plurality of said round wires leaving end portions of said plurality uncovered, removing said coating from at least part of said end portions projecting from said connecting tape to form a group of exposed conductors, and applying a securing tape on an underside of said group of exposed conductors whereby said securing tape extends over a part of said coating.

* * * * *